US008337976B2

(12) United States Patent
Mayers et al.

(10) Patent No.: US 8,337,976 B2
(45) Date of Patent: Dec. 25, 2012

(54) ABUSE-RESISTANT CAST ACOUSTICAL CEILING TILE HAVING AN EXCELLENT SOUND ABSORPTION VALUE

(75) Inventors: Thomas M. Mayers, Crystal Lake, IL (US); David B. Bitzan, Kansas City, MO (US); Jeffry T. Russart, Williams Bay, WI (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 10/789,000

(22) Filed: Feb. 26, 2004

(65) Prior Publication Data

US 2005/0191465 A1 Sep. 1, 2005

(51) Int. Cl.

| | |
|---|---|
| ***D06N 7/04*** | (2006.01) |
| ***E04D 1/28*** | (2006.01) |
| ***B32B 5/14*** | (2006.01) |
| ***B32B 3/00*** | (2006.01) |
| ***B32B 5/16*** | (2006.01) |
| ***B32B 7/00*** | (2006.01) |
| ***B32B 5/26*** | (2006.01) |
| ***B32B 17/00*** | (2006.01) |
| ***B27N 3/00*** | (2006.01) |
| ***E04B 1/82*** | (2006.01) |
| ***E04B 9/00*** | (2006.01) |

(52) U.S. Cl. ..... 428/143; 428/150; 428/170; 428/171; 428/206; 156/62.8; 181/284; 181/286; 181/290; 181/291

(58) Field of Classification Search ..... 428/141, 428/143, 147

See application file for complete search history.

(56) References Cited

U.S. PATENT DOCUMENTS

| | | | | |
|---|---|---|---|---|
| 1,925,282 | A | 9/1933 | Robinson | |
| 1,966,069 | A | 7/1934 | Kliefoth | |
| 3,184,372 | A * | 5/1965 | Cotts | 162/145 |
| 3,357,516 | A | 12/1967 | Cadotte et al. | |
| 3,870,540 | A | 3/1975 | Norgard | |
| 3,933,561 | A * | 1/1976 | Larson et al. | 156/246 |
| 3,963,847 | A | 6/1976 | Norgard | |
| 3,968,274 | A | 7/1976 | Harris et al. | |
| 4,585,685 | A * | 4/1986 | Forry et al. | 428/143 |
| 5,076,985 | A | 12/1991 | Koch et al. | |
| 5,753,871 | A * | 5/1998 | Kahara et al. | 181/290 |
| 6,228,422 | B1 | 5/2001 | White et al. | |
| 6,268,042 | B1 * | 7/2001 | Baig | 428/211.1 |
| 6,334,280 | B1 | 1/2002 | Frappart et al. | |
| 6,616,804 | B2 * | 9/2003 | Foster et al. | 162/129 |
| 2002/0139611 | A1 * | 10/2002 | Baig | 181/286 |

* cited by examiner

*Primary Examiner* — David Sample
*Assistant Examiner* — Nathan Van Sell
(74) *Attorney, Agent, or Firm* — Greer, Burns & Crain, Ltd.; Pradip Sahu, Esq.; Philip T. Petti, Esq.

(57) ABSTRACT

An abuse-resistant, cast acoustical ceiling tile having improved impact resistance and excellent sound absorption values. The ceiling tiles have aggregate particles applied to the surface of a wet pulp in the casting process and the particles are embedded in the pulp by compression with a roll and/or smooth plates. The aggregate particles have an average particle diameter of at least about 1,000 microns. The ceiling tiles have excellent sound absorption properties with a noise reduction coefficient (NRC) of at least about 0.50. Calcium carbonate is the preferred aggregate particle material.

9 Claims, 2 Drawing Sheets

ABUSE-RESISTANT CAST ACOUSTICAL CEILING TILE HAVING AN EXCELLENT SOUND ABSORPTION VALUE

FIELD OF THE INVENTION

This invention relates to an acoustical ceiling tile having an abuse-resistant surface while maintaining an excellent sound absorption value. More particularly, this invention relates to a cast acoustical ceiling tile having an aggregate material applied to its surface to provide abuse resistance. A layer of aggregate particles is applied to the surface and compressed with a roll or smooth plates to bond the aggregate particles to the ceiling tile. Another feature of the invention is providing a cast ceiling tile having excellent sound absorption values.

BACKGROUND OF THE INVENTION

Acoustical ceiling tiles can be made by a wet pulp molding or cast process such as described in U.S. Pat. No. 1,769,519. In accordance with this process, a molding composition comprising granulated mineral wool fibers, fillers, colorants and a binder (e.g. starch gel), is prepared for molding or casting the tile. The composition is placed upon suitable trays which have been covered with paper or a metallic foil and then the composition is screeded to a desired thickness with a screed bar or roller. A decorative surface, such as elongated fissures, may be provided by the screed bar or roller. The trays filled with the mineral wool composition are then placed in an oven to dry or cure.

U.S. Pat. No. 4,585,685 discloses acoustical ceiling tiles which are produced by applying aggregate material to the surface of a dry-formed web comprising a fibrous material and an organic binder, and consolidating the composite material such that the aggregate material is embedded in the web. In Example 1 of this patent, a wetlaid board was prepared by means known in the art using a fourdrinier machine. While the dewatered sheet resided on the wire, a dry layer of perlite was applied, the layered sheet was passed through a press section, and the consolidated sheet was separated from the wire. The sheet was then dried in a conventional manner by passing it through a heating tunnel. The sheet was subjected to an acoustics test (ASTM C423) and its NRC (noise reduction coefficient) was 0.28. The patentees concluded that this acoustical performance was unacceptable.

It is an object of this invention to provide a cast acoustical tile having an abuse-resistant surface formed from aggregate particles and having an excellent sound absorption value.

It is another object of this invention to provide a process for making an abuse-resistant ceiling tile wherein aggregate particles are applied to a wet ceiling tile substrate after which they are pressed with a roll and/or smooth plates to bond the aggregate particles to the substrate.

It is a further object of this invention to provide an abuse-resistant, cast ceiling tile having a sound absorption value (NRC) of at least about 0.50.

These and other objects will be apparent to persons skilled in the art in view of the description that follows.

DETAILED DESCRIPTION OF THE INVENTION

Figure 1:
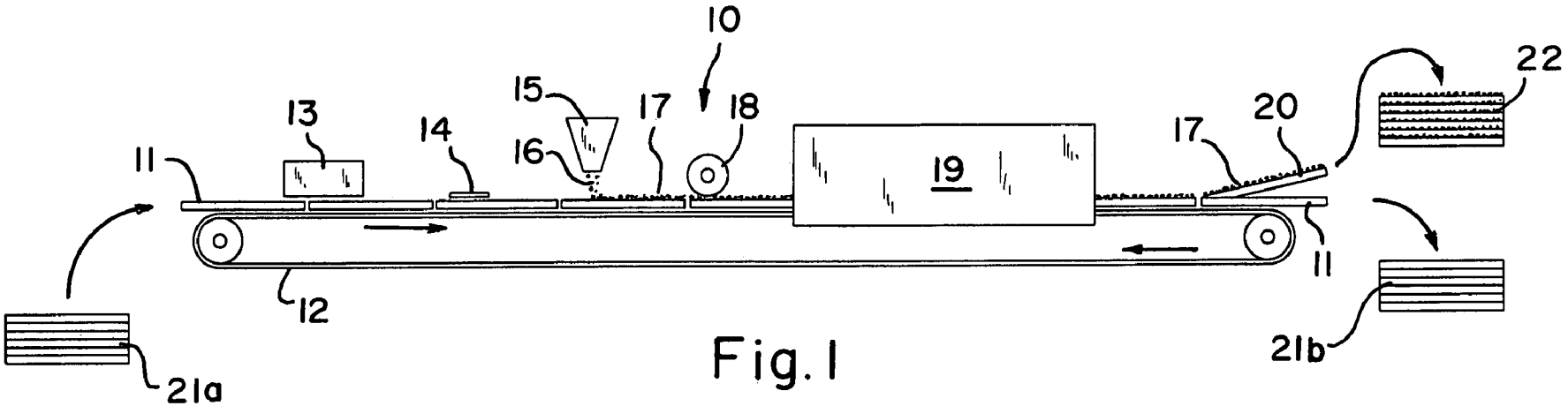
FIG. 1 is a schematic drawing of a production line illustrating a casting process for producing acoustical ceiling tiles in which aggregate particles are applied to the wet surface of the cast tile substrate and subsequently compressed to embed the particles in the tile.

It has been discovered that the application of aggregate particles to the surface of a molded or cast acoustical ceiling tile will provide a very durable, abuse-resistant tile which also has excellent sound absorption values (NRC). The aggregate particles are applied to the wet molded or cast ceiling tile substrate. The wet molded or cast ceiling tile substrate comprises a slurry or pulp including granulated mineral wool fibers and an organic binder such as a starch gel. The slurry or pulp may also include other ingredients such as fillers and colorants.

A uniform, highly durable surface is achieved by depositing a layer of aggregate particles to the wet surface of the molded or cast ceiling tile and pressing the particles into the wet surface with a roll and/or smooth plates to ensure good bonding of the aggregate particles to the ceiling tile substrate. After passing the wet ceiling tile and embedded aggregate particles through a drier, the resulting product has a monolithic, textured appearance with excellent impact resistance and acoustical performance.

The slurry or pulp is prepared by mixing the granulated mineral wool fibers, organic binder, fillers and water to form a homogeneous, aqueous mixture. The slurry or pulp is conveyed to a headbox from which it is evenly distributed into metal trays that are continuously passed under the headbox. The trays may be lined with paper or foil-backed paper to prevent the pulp from sticking to the trays in the drying process. The thickness of the pulp in the trays is regulated by an adjustable plate positioned at the exit of the headbox. The trays containing the wet pulp are passed under the adjustable plate before applying the aggregate particles.

It is generally preferred that the organic binder be a starch gel which is prepared by heating a starch slurry to a temperature between about 180° F. (about 80° C.) and 210° F. (about 100° C.) until the starch is fully cooked and the slurry thickens to a viscous gel. The starch slurry may have the following general formulation:

| Ingredient | Weight % |
|---|---|
| Starch | 3–5.7 |
| Calcined Gypsum and Cull (50/50) | 3–10 |
| Boric Acid | 0–1.1 |
| Clay | 3–10 |
| Water | 82.7–94.2 |

The pulp may be prepared by mixing the starch gel and mineral wool fibers in a pulp mixer for about 4-12 minutes to form a homogeneous mix. The pulp mix may contain the following amounts:

| Ingredient | Weight % |
|---|---|
| Starch Gel | 75–83 |
| Mineral Wool Fibers | 17–25 |

The aggregate particles may be selected from limestone (calcium carbonates), crushed marble, sand (silicon oxide), clays, perlite, vermiculite, crushed stone and glass particles. The preferred aggregate particles are calcium carbonate, which provide a bright white appearance.

Aggregate particles are deposited on the pulp surface after the headbox feeding the pulp to the tray, and preferably after the pulp in the tray has its thickness calibrated by passing under an adjustable plate. The aggregate particles are fed from a hopper in such a way as to provide for uniform distribution across the width of the pulp in the tray. The aggregate particles are distributed across the pulp in the tray by a hopper-fed particle applicator consisting of a machined roll that is knurled or fluted so as to provide good cross-machine distribution of particles. The knurled or fluted roll drops the particles onto the pulp surface at a uniform rate that can be adjusted by varying the speed of the roll using a variable frequency drive or rheostat. Application rates may range from about 0.1 to about 1 lb./ft.$^2$. The preferred application rates are from about 0.2 to about 0.5 lb./ft.$^2$.

It has been found that when using calcium carbonate particles the average particle size (mean diameter) should be at least about 1,000 microns. Particles smaller than 1,000 microns do not provide improved impact resistance. The aggregate particle sizes (mean diameter) may range from about 1,000 microns to about 3,000 microns, with the preferred range being from about 1,400 to about 2,500 microns.

The process for making the abuse-resistant acoustical ceiling tiles having an excellent sound absorption value is illustrated in FIG. 1 which is a schematic drawing of a production line. The production line (10) is used to produce cast or molded acoustical ceiling tiles. This process utilizes paper or paper/foil lined trays (11) which are fed to a moving belt system (12). The lined trays (11) from a stack of trays (21*a*) are passed under a headbox (13) which contains the granulated mineral fiber pulp or slurry. The pulp or slurry is deposited in the lined metal trays (11) which are continuously passed under the headbox (13).

After the trays (11) are filled with pulp or slurry, the filled trays (11) are passed under an adjustable plate (14) which is used to control the thickness of the pulp in the tray (11). Thereafter, the pulp-filled tray (11) is passed under a hopper (15) which contains aggregate particles (16). The aggregate particles (16) are preferably calcium carbonate and are fed from the hopper (15) so as to provide a uniform layer (17) of aggregate particles (16) across the width of the pulp in the tray (11).

The tray (11) containing the pulp covered by a layer of aggregate particles (16) is passed under a roll (18) or smooth plates (not shown) to press the particles (16) into the pulp. The roll (18) is adjusted so as to press the aggregate particles (16) into the surface of the pulp while maintaining adequate thickness control of the wet pulp. This is accomplished by adjusting the height of the roll (18). If necessary, multiple rolls (18) or smoothing plates may be used to achieve adequate bonding of the aggregate particles to the pulp surface and to obtain good thickness control.

The tray (11) containing the wet pulp covered by a layer (17) of aggregate particles (16) is passed into a drier (19) wherein the pulp is dried. Thereafter, the dried ceiling tile (20) covered by a layer (17) of aggregate particles is removed from the tray (11) and is placed in stacks (22) awaiting the finishing steps (not shown). The finishing steps may comprise trimming and cutting operations, surface painting, and/or scoring operations. The empty trays (11) are placed in stacks (21*b*) and thereafter are lined with paper or paper/foil and the process is repeated.

Figure 2:
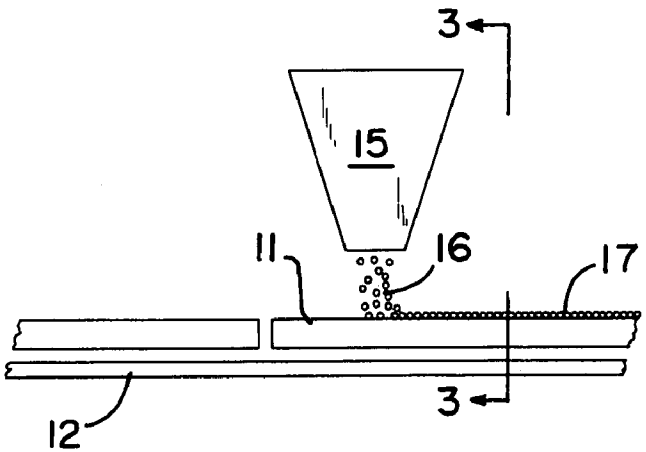
FIG. 2 is a schematic drawing showing a close-up view of a hopper which is used to feed aggregate particles to the wet ceiling tile surface.

As shown in greater detail in FIG. 2, the hopper (15) contains aggregate particles (16) which are fed onto the wet surface of the pulp in tray (11). The aggregate particles (16) are distributed across the pulp in the tray (11) by means of the hopper (15) in which a machined roll (not shown) that is knurled or fluted so as to provide a uniform layer (17) of aggregate particles (16) across the wet surface of the pulp. As previously reported, the most preferred aggregate particles (16) are calcium carbonate, which have a bright white appearance.

Figure 3:
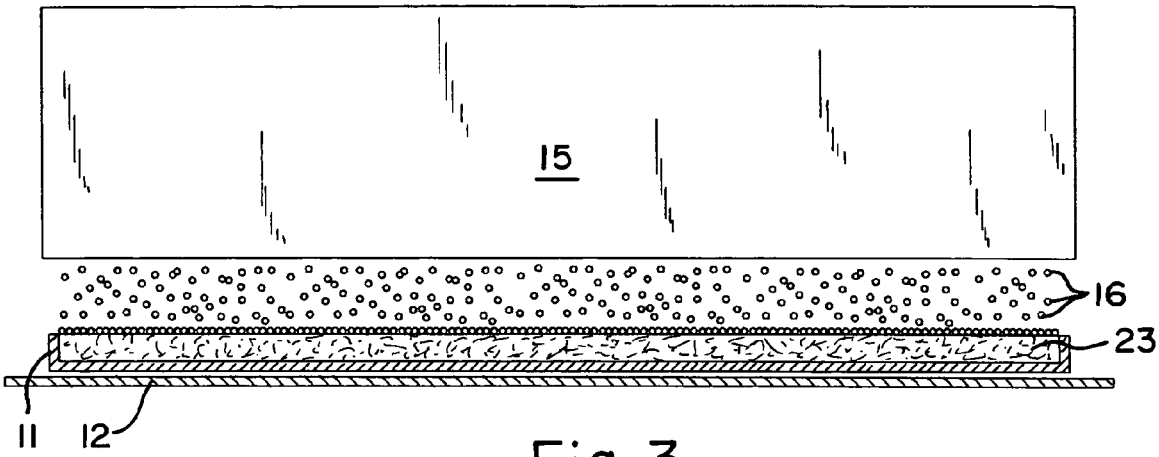
FIG. 3 is a cross-sectional view taken along the line 3-3 of FIG. 2.

FIG. 3 is a cross-sectional view taken along line 3-3 of FIG. 2 in which the wet pulp (23) is clearly illustrated. The metal tray (11) carries the wet pulp (23) on the belt system (12) under the hopper (15) from which the aggregate particles (16) are uniformly distributed on the surface of the wet pulp (23).

Figure 4:
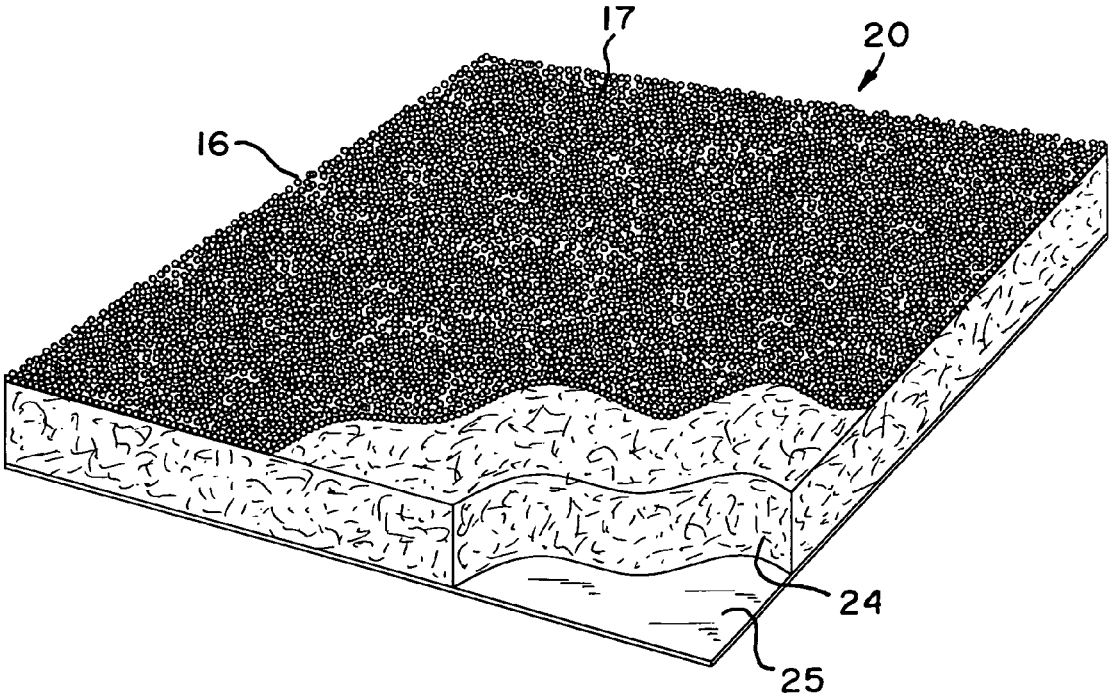
FIG. 4 is an isometric view of an acoustical ceiling tile having a surface layer of aggregate particles embedded in the tile substrate.

The dried ceiling tile (20) is shown in FIG. 4. This ceiling tile comprises a uniform layer (17) of aggregate particles (16) on the surface of a cast mineral fiber core (24). On the back surface of the tile is a paper or foil-backed paper (25) sheet which is placed in each tray (11) before it passes under the headbox (13). The ceiling tile (20) is characterized by having an abuse-resistant surface and an excellent sound absorption value (NRC).

Ceilings in schools, stadiums and other public places are subject to greater abuse than other applications such as office buildings. Impact resistance is one way to measure abuse resistance. Impact resistance measures how deeply a spherical object indents or penetrates a ceiling's surface at variable levels of force or energy. The weight of the spherical object in conjunction with the height from which it is applied is used to vary the force. In the examples which follow, the spherical object ("hammer") had a diameter of 0.625 inch and the weight was 0.5 lbs. ASTM D 5420 was used as a guide for the impact resistance ("durability") tests. It should be noted that the impact resistance test is used to compare different products rather than evaluate them separately.

A Gardner impact tester was used to conduct the tests. The steel striker (hammer) had a round nose with a 0.625 inch diameter and it weighed 0.5 lbs. Each test result was the average of three samples. The samples were 3"×10" cut from the ceiling tile.

The tests were carried out by placing the steel striker in the Gardner tester and the ceiling tile samples were placed in the sample holder, face up. The steel striker was initially dropped from the 1.0 inch height and allowed to free fall onto the sample. After each impact test, the sample would be moved to the next number, increasing the height after each impact. The test would be continued with each sample until visible damage was observed, i.e. cracking of the surface.

Mean failure energy (MFE) was calculated by the following equation:

$$MFE=hwf$$

Wherein h is the mean failure height (inches), w is the striker mass (lbs), and the f value (a factor for conversion to joules) was set at 1.0 for inch-pound units. If desired to actually convert the inch-pound units to joules, the calculation should be made using an f value of 0.11299.

A standard manufacturing process for producing cast acoustical ceiling tiles was used to prepare the ceiling tiles used in the following examples. In addition, the process of this invention was used to prepare the abuse-resistant tiles (designated AR). A starch gel binder was prepared by dispersing starch in water to form a slurry. The starch slurry was heated to a temperature between about 180° F. (about 80° C.) and 210° F. (about 100° C.) until the starch was fully cooked and the slurry thickened to a viscous gel. Additional ingredients were incorporated into the starch gel whereby it had the following formulation:

| Ingredient | Weight % |
|---|---|
| Starch | 5.03 |
| Calcined Gypsum and Cull (50/50) | 4.94 |
| Boric Acid | 0.2 |
| Calgon | 0.03 |
| Water | 89.8 |

The pulp was prepared by mixing the starch gel and mineral wool fibers in a pulp mixer for about 7 minutes to form a homogeneous mix. The pulp mix contained the following amounts:

| Ingredient | Weight % |
|---|---|
| Starch Gel | 75.4 |
| Mineral Wool Fibers | 24.6 |

Example 1

Cast acoustical tiles were made using the above-listed formulations. Standard cast acoustical tiles were made and abuse-resistant (AR) tiles were made in accordance with this invention as illustrated in the figures. The tiles were subjected to the impact resistance test described above. The following test results were recorded:

| Ceiling Tile | Impact Resistance (in .lb f) |
|---|---|
| Standard Cast Tile | 3.5 |
| AR Cast Tile | 5.5 |

The AR Cast Tile with a surface of calcium carbonate particles had a significantly improved impact resistance.

Example 2

Impact resistance tests were performed on cast acoustical tiles having the same standard formulation as the tiles in Example 1 and evaluating calcium carbonate particles having different particle sizes. The particle sizes were as follows:

| | Avg. Particle Mean Diameter (microns) |
|---|---|
| Fine | 800 |
| Medium | 1,400 |
| Coarse | 2,500 |

The impact resistance test results were as follows:

| Ceiling Tile | Impact Resistance (in .lb f) |
|---|---|
| Standard Cast Tile | 2.75 |
| AR Cast Tile (Fine Particles) | 2.75 |

-continued

| Ceiling Tile | Impact Resistance (in .lb f) |
|---|---|
| AR Cast Tile (Medium Particles) | 4.0 |
| AR Cast Tile (Coarse Particles) | 4.5 |

The cast tiles with the fine particles (average particle mean diameter of 800 microns) applied to the surface did not provide improved impact resistance. The cast tiles with the medium and coarse particles applied to the surface had significant improvement in their impact resistance.

Example 3

The cast acoustical tiles of Example 2 were tested for their sound absorption properties. The noise reduction coefficient (NRC) values were determined using the Impedance tube method. The NRC values were as follows:

| Ceiling Tile | NRC |
|---|---|
| Standard Cast Tile | 0.733 |
| AR Cast Tile (Fine Particles) | 0.724 |
| AR Cast Tile (Medium Particles) | 0.751 |
| AR Cast Tile (Coarse Particles) | 0.753 |

The cast tiles with the medium and coarse particles applied to the surface had excellent sound absorption (NRC) values.

Having completely and fully described this invention in the specification, examples and drawings, what is claimed is:

1. An abuse-resistant, cast acoustical ceiling tile having a core made from a wet composition of starch gel and mineral wool fiber, with the starch gel ranging from 75 to 83 weight percent of the core composition and the mineral wool fibers ranging from 17 to 25 weight percent of the core composition, wherein a front surface of the ceiling tile includes aggregate particles partially embedded in a surface of said core, said aggregate particles having an average particle mean diameter of at least about 1,000 microns and wherein said starch gel comprises at least about 82.7 weight % water.

2. The ceiling tile of claim 1 wherein the aggregate particles are selected from the group consisting of calcium carbonate, crushed marble, sand, clay, perlite, vermiculite, crushed stone and glass.

3. The ceiling tile of claim 2 wherein the aggregate particles are calcium carbonate.

4. The ceiling tile of claim 3 wherein the aggregate particles have an average particle mean diameter ranging from about 1,000 microns to about 3,000 microns.

5. The ceiling tile of claim 3 wherein the aggregate particles have an average particle mean diameter ranging from about 1,400 microns to about 2,500 microns.

6. The ceiling tile of claim 1 which has a noise reduction coefficient (NRC) value of at least about 0.50.

7. The ceiling tile of claim 2 which has a noise reduction coefficient (NRC) value of at least about 0.50.

8. The ceiling tile of claim 3 which has a noise reduction coefficient (NRC) value of at least about 0.50.

9. The ceiling tile of claim 4 which has a noise reduction coefficient (NRC) value of at least about 0.50.

* * * * *